US008714460B2

(12) United States Patent
Santinanavat et al.

(10) Patent No.: US 8,714,460 B2
(45) Date of Patent: May 6, 2014

(54) MULTI-STAGE VARIABLE OUTPUT VALVE UNIT

(75) Inventors: Mike Santinanavat, Chesterfield, MO (US); Mark H. Stark, St. Louis, MO (US); Shweta Annapurani Panimadai Ramaswamy, Maryland Heights, MO (US); John Broker, Warrenton, MO (US)

(73) Assignee: Emerson Electric Co., St. Louis, MO (US)

( * ) Notice: Subject to any disclaimer, the term of this patent is extended or adjusted under 35 U.S.C. 154(b) by 506 days.

(21) Appl. No.: 13/099,763

(22) Filed: May 3, 2011

(65) Prior Publication Data

US 2012/0279571 A1 Nov. 8, 2012

(51) Int. Cl.
*G05D 23/32* (2006.01)

(52) U.S. Cl.
USPC ..... 236/46 E; 137/624.12; 700/282; 126/116 A

(58) Field of Classification Search
CPC ..... G05D 7/0635; G05D 23/1904; G05D 23/1951; F23N 5/203
USPC ..... 137/487.5, 624.11, 624.12; 251/30.01, 251/30.02, 30.03, 30.04, 30.05; 700/282; 165/267; 236/46 E, 11; 126/116 A
See application file for complete search history.

(56) References Cited

U.S. PATENT DOCUMENTS

| | | | | |
|---|---|---|---|---|
| 5,062,446 | A | 11/1991 | Anderson | |
| 6,161,535 | A | 12/2000 | Dempsey et al. | 126/110 R |
| 6,283,115 | B1 | 9/2001 | Dempsey et al. | 126/110 R |
| 6,925,999 | B2 * | 8/2005 | Hugghins et al. | 126/116 A |
| 7,296,595 | B2 | 11/2007 | Santinanavat et al. | 137/614.19 |
| 7,469,546 | B2 * | 12/2008 | Kates | 62/129 |
| 7,731,096 | B2 | 6/2010 | Lorenz et al. | 236/1 C |
| 2007/0090198 | A1 * | 4/2007 | Hugghins | 236/46 E |
| 2007/0095520 | A1 * | 5/2007 | Lorenz et al. | 165/267 |
| 2008/0297288 | A1 | 12/2008 | Irwin | |
| 2010/0009303 | A1 | 1/2010 | Santinanavat et al. | 431/12 |

FOREIGN PATENT DOCUMENTS

WOPCT/US2012/0022400 2/2012

OTHER PUBLICATIONS

U.S. Appl. No. 61/444,956, filed Feb. 21, 2011, Stark et al.
U.S. Appl. No. 13/031,517, filed Feb. 21, 2011, Broker et al.
"MAXITROL—EXA Valve Series Operating Instructions", www.maxitrol.com; 2009; pp. 1-4.

* cited by examiner

*Primary Examiner* — William McCallister
(74) *Attorney, Agent, or Firm* — Harness, Dickey & Pierce, P.L.C.

(57) ABSTRACT

A valve unit for adjusting gas flow to a two-stage combustion apparatus includes a valve member that is moved by a magnetic field generated by a coil to vary gas flow rate through the valve unit, and first and second connectors configured to receive a high-stage activation signal and a low-stage activation signal, respectively. The valve unit includes a valve controller that is configured to control the coil to establish a high-stage gas flow rate while the high-stage activation signal is present, and configured to control the coil to establish a low-stage gas flow rate while the low stage activation signal is present up to a predetermined low stage time limit. The valve controller is further configured to establish at least one gas flow rate between the low-stage and high-stage gas flow rates when the low stage activation signal is present beyond the predetermined low stage time limit.

19 Claims, 5 Drawing Sheets

MULTI-STAGE VARIABLE OUTPUT VALVE UNIT

FIELD OF THE INVENTION

The present disclosure relates to systems for control of a gas fired appliance having a gas valve, and more particularly relates to gas valves for control of gas flow to such an appliance.

BACKGROUND

The statements in this section merely provide background information related to the present disclosure and may not constitute prior art.

A gas-fired, warm air furnace that operates at two fixed gas flow rates is generally referred to as a two-stage furnace. Two stage furnaces are frequently selected by homeowners over single stage furnaces because they offer increased performance and comfort. However, in two stage heating furnaces, the furnace control is only configured for operating a two stage gas valve at a fixed high gas flow rate and a fixed low gas flow rate. Such two stage gas valves are not capable of providing variable heating, and cannot be readily replaced by modulating gas valves. Accordingly, a need still exists for an improved valve unit and associated control for present two stage heating systems.

SUMMARY

Further areas of applicability will become apparent from the description provided herein. It should be understood that the description and specific examples are intended for purposes of illustration only and are not intended to limit the scope of the present disclosure.

Various embodiments are provided of a valve unit and an associated valve controller for a two stage heating apparatus. One embodiment of a valve unit for adjusting gas flow to a two-stage combustion apparatus includes a valve member that is moved by a magnetic field generated by a coil to vary gas flow rate through the valve unit, and first and second connectors configured to receive a high-stage activation signal and a low-stage activation signal, respectively. The valve unit includes a valve controller that is configured to control the coil to establish a high-stage gas flow rate while the high-stage activation signal is present, and configured to control the coil to establish a low-stage gas flow rate while the low stage activation signal is present up to a predetermined low stage time limit. The valve controller is further configured to establish at least one gas flow rate between the low-stage and high-stage gas flow rates when the low stage activation signal is present beyond the predetermined low stage time limit.

In another preferred embodiment, the valve unit includes the above disclosed valve member that moves via a magnetic field generated to vary gas flow rate through the valve unit, and first and second connectors configured to receive a high-stage activation signal and a low-stage activation signal, respectively. The valve unit further includes a valve controller that is alternatively configured to determine a low stage time limit based on a percentage of at least one heating cycle time period in which the low stage activation signal is present. The valve controller is configured to control the coil to establish a high-stage gas flow rate while the high-stage activation signal is present, and configured to control the coil to establish a low-stage gas flow rate while the low stage activation signal is present up to the low stage time limit. The valve controller is configured to establish at least one gas flow rate between the low-stage and high-stage gas flow rates when the low stage activation signal is present beyond the low stage time limit.

Further areas of applicability will become apparent from the description provided herein. The description and specific examples provided in this summary are intended for purposes of illustration only and are not intended to limit the scope of the disclosure.

DRAWINGS

The drawings described herein are for illustration purposes only and are not intended to limit the scope of the present disclosure in any way.

Figure 4:
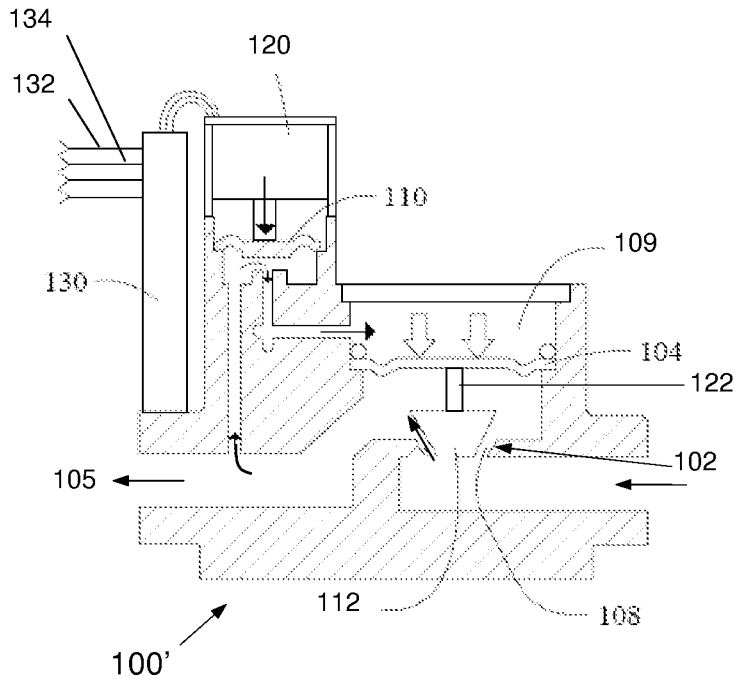
Figure 5:
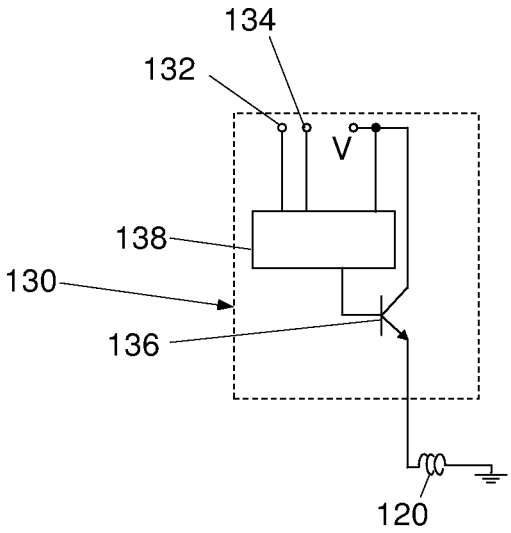

FIG. 4 a cross-sectional view of a second embodiment of a multi-stage valve unit for controlling gas flow within a two-stage heating apparatus; and FIG. 5 shows a schematic diagram of a valve controller, according to the principles of the present disclosure.

Corresponding reference numerals indicate corresponding parts throughout the several views of the drawings.

DETAILED DESCRIPTION

The following description is merely exemplary in nature and is not intended to limit the present disclosure, application, or uses. It should be understood that throughout the drawings, corresponding reference numerals indicate like or corresponding parts and features.

According to one aspect of the present disclosure, various embodiments are provided of a multi-stage valve unit that is operable with two-stage controllers for controlling conventional two-stage gas valves having fixed high and low gas flow rates. In one preferred embodiment, a valve unit for adjusting gas flow to a two-stage combustion apparatus includes a valve member that is moved by a magnetic field generated by a coil to vary gas flow rate through the valve unit, and first and second connectors configured to receive a high-stage activation signal and a low-stage activation signal, respectively. The valve unit includes a valve controller that is configured to control the coil to establish a high-stage gas flow rate while the high-stage activation signal is present, and configured to control the coil to establish a low-stage gas flow rate while the low stage activation signal is present up to a predetermined low stage time limit. The valve controller is further configured to establish at least one gas flow rate between the low-stage and high-stage gas flow rates when the low stage activation signal is present beyond the predetermined low stage time limit.

In another preferred embodiment, the valve unit includes the above disclosed valve member that moves via a magnetic field generated to vary gas flow rate through the valve unit, and first and second connectors configured to receive a high-stage activation signal and a low-stage activation signal, respectively. The valve unit further includes a valve controller that is alternatively configured to determine a low stage time limit based on a percentage of at least one heating cycle time period in which the low stage activation signal is present. The valve controller is configured to control the coil to establish a high-stage gas flow rate while the high-stage activation signal is present, and configured to control the coil to establish a low-stage gas flow rate while the low stage activation signal is present up to the low stage time limit. The valve controller is configured to establish at least one gas flow rate between the low-stage and high-stage gas flow rates when the low stage activation signal is present beyond the low stage time limit.

Figure 1:
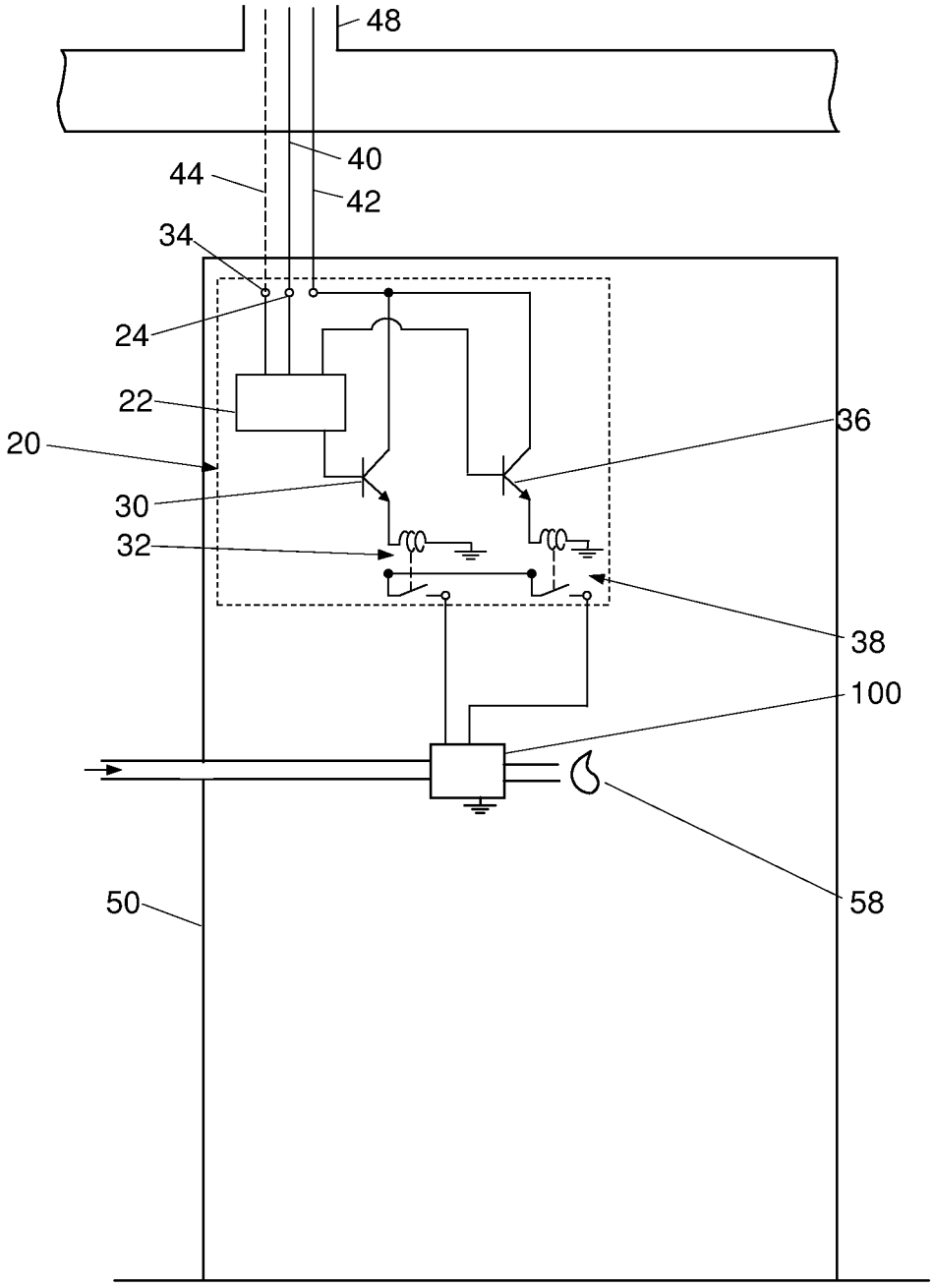
FIG. 1 depicts a schematic diagram for a two-stage controller, shown within a two-stage heating apparatus having a valve unit that is operable with the two-stage controller.

The various embodiments of a multi-stage valve unit are adapted to be connected to and operable with a two-stage controller for a furnace or heating unit, where the two-stage controller initiates operation of the heating unit based on a signal from either a single-stage or two-stage thermostat. To better illustrate the function of the various valve unit embodiments, a two-stage controller for a furnace or heating unit is described for purposes of explanation of system operation. The two-stage controller 20 shown in FIG. 1 includes a microcontroller 22, and a connection for receiving electrical power via wire 42. The two-stage controller 20 also includes a first input terminal 24 for receiving a heat activation signal from a thermostat (via a "W" terminal that is typically found on thermostats).

Where the thermostat is a single stage thermostat, the thermostat sends only a single "W" signal to the first terminal 24 via a wire 40 passing through a wall 48 to the two-stage controller 20 of the heating unit 50. Within a predetermined time after detecting the "W" signal (and establishing ignition), the two-stage controller 20 is configured to signal a valve unit 100 to establish a low-stage gas flow rate for a predetermined time period. The two-stage controller 20 may thereafter signal the valve unit 100 to establish a high-stage gas flow rate after the predetermined time period elapses. Specifically, the two-stage controller 20 controls a first switching means 30 for switching a voltage source (via wire 42) to a relay device 32 that switches voltage to a valve unit 100 to establish a low stage gas flow rate, and a second switching means 36 for switching the voltage source (via wire 42) to a relay device 38 that switches voltage to a second connection on the valve unit 100 to establish a high stage full-capacity gas flow rate to a burner 58. Accordingly, the two-stage controller 20 is capable of receiving a single request signal at a first terminal 24, and responsively switching the first and second switching means 30, 36 to establish operation in either first stage or second stage heat mode. The two-stage controller 20 is configured to control the operation of the valve unit 100 to provide low stage operation, and to provide high stage full-capacity operation after a predetermined time period of low stage heating operation has elapsed.

Where a two stage thermostat is employed, the two stage thermostat sends a "W1" low stage signal to the first terminal 24 of the two-stage controller 20 via wire 40, and a "W2" high stage signal to a second terminal 34 of the two-stage controller 20 via a second wire 44. In response to the "W1" signal, the two-stage controller 20 is configured to control the operation of the valve unit 100 to provide low stage heating operation. In response to the "W2" signal, the two-stage controller 20 is configured to control the operation of the valve unit 100 to provide high stage heating operation. Accordingly, the two-stage controller 20 is configured to send both a low-stage heat activation signal and a high-stage heat activation signal for controlling the operation of the valve unit 100 to establish low stage heating operation and high stage full-capacity heating operation, as explained below.

Figure 2:
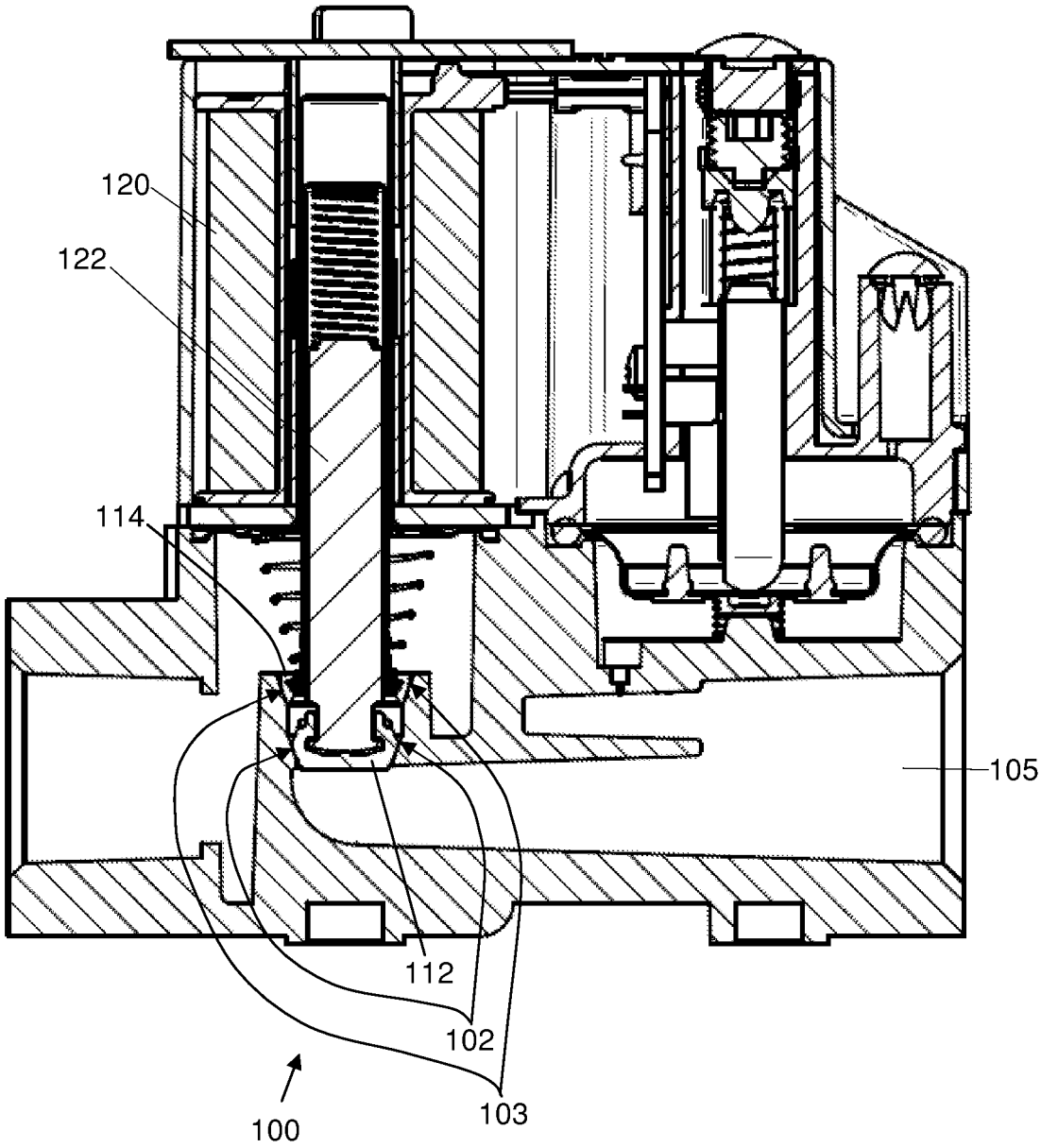
FIG. 2 shows a cross-sectional view of one embodiment of a multi-stage valve unit for controlling gas flow within a two-stage heating apparatus.

Referring to FIG. 2, one exemplary embodiment of a valve unit 100 for adjusting gas flow to a two stage heating unit or combustion apparatus. The valve unit 100 includes a valve member 122 that is moved in response to a magnetic field generated by a coil 120 to move relative to a valve seat 102 to vary a gas flow rate through the valve unit 100 to a valve outlet 105. The valve member 122 is configured to move to vary the gas flow rate based on a magnitude of the generated magnetic field, which is dependent on an input voltage applied to the coil 120.

Specifically, the valve unit 100 includes a first valve seat 102, a second valve seat 103 substantially co-aligned with the first valve seat 102, and an outlet 105, as shown in FIG. 2. The valve unit 100 includes a first valve element 112 that is spaced from the first valve seat 102 when the first valve element 112 is in an open position, and seated against the first valve seat 102 when the first valve element 112 is in a closed position. The valve unit 100 includes a second valve element 114 substantially co-aligned with the first valve element 112 and moveable relative to the second valve seat 103, where the second valve element 114 is spaced from the second valve seat 103 when the second valve element 114 is in an open position, and seated against the second valve seat 103 when the second valve element 114 is in a closed position. The valve unit 100 further includes a coil 120 and a valve member 122 that operatively moves the first valve element 112 and second valve element 114 in response to a magnetic field generated by the coil 120. The valve member 122 is further configured to move the first and second valve elements 112, 114 relative to at least the second valve seat 103 to vary an opening area therebetween. The valve member 122 is configured to move a first distance to pull the first valve element 112 away from a closed position against the first valve seat 102, and to move beyond the first distance to pull the second valve element 114 away from a closed position against the second valve seat 103 and towards an open position. One example of such a valve design is disclosed in U.S. Provisional Patent Application Ser. No. 61,444,956 filed on Feb. 21, 2011, which is entitled "Valves And Pressure Sensing Devices For Heating Appliances" and is incorporated herein by reference.

The coil 120 is preferably a solenoid coil that is configured to move the valve member 122 relative to the valve seats 102, 103 to vary the opening area therebetween based on a magnitude of the generated magnetic field, which is dependent on an input voltage applied to the coil 120. Accordingly, the valve member 122 can move the first valve element 112 and second valve element 114 away from the valve seats 102 and 103 and vary the opening area between the first and second valve elements 112, 114 and the first and second valve seats 102, 103, to thereby control pressure at the outlet 105. By controlling the input voltage that is applied to generate a magnetic field to move the valve member 122, the valve unit 100 can vary the extent of opening area between the first and second valve seats 102, 103 and the first and second valve elements 112, 114.

Figure 3:
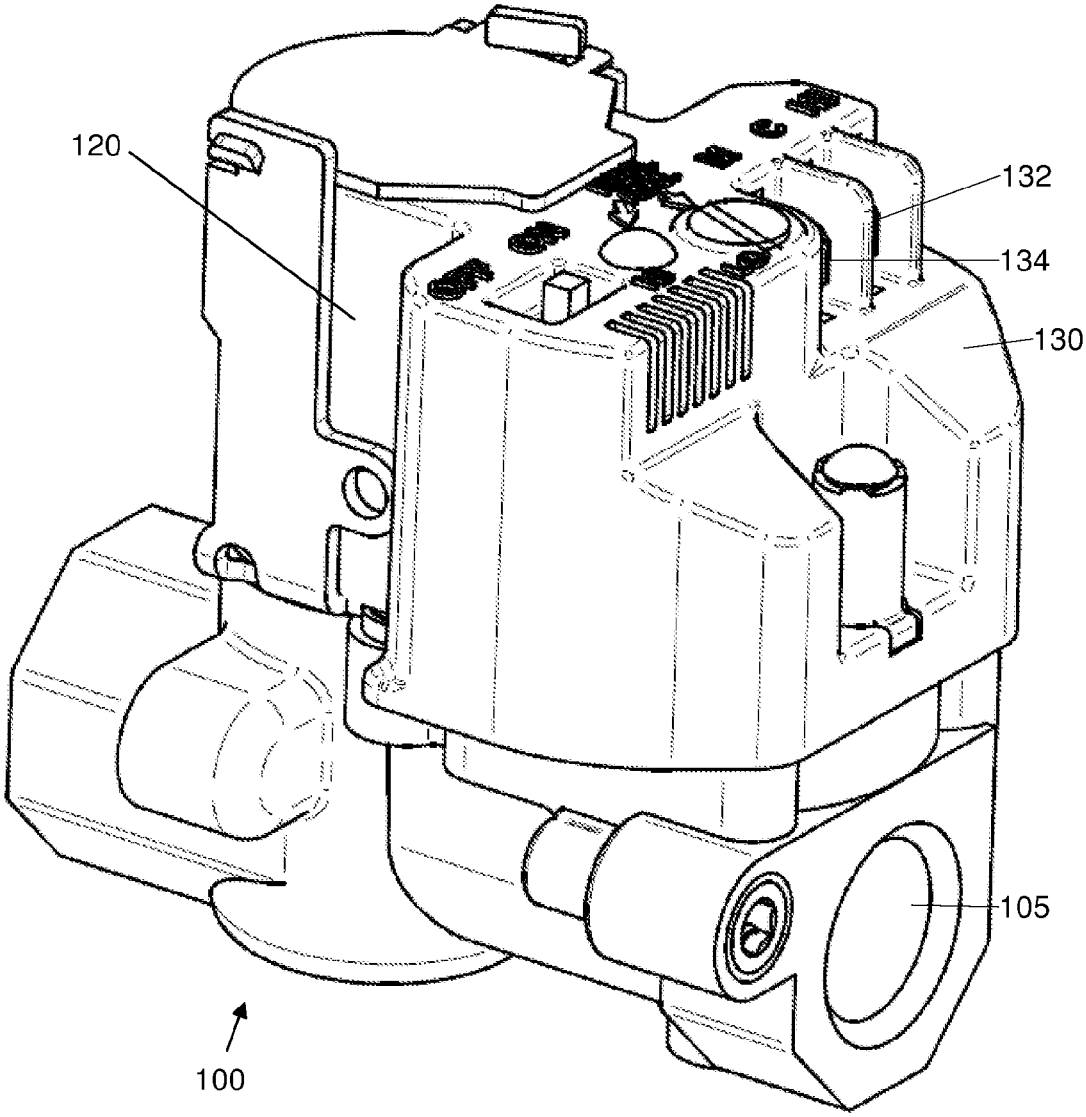
FIG. 3 shows a perspective view of the multi-stage valve unit in FIG. 2, according to the principles of the present disclosure.

Referring to FIG. 3, the valve unit 100 preferably includes a controller 130 for controlling input to the coil 120. The valve unit 100 includes a first connector 132 configured to receive a high-stage activation signal, and a second connector 134 configured to receive a low-stage activation signal. Based on the low-stage and high-stage activation signals, the valve unit 100 controls the input of voltage to the coil 120 and movement of the valve member 122 is controlled utilizing a valve controller to vary the gas flow rate through the outlet 105 of the valve unit 100, as explained below.

The valve unit 100 includes a valve controller 130 that is configured to control input to the coil 120 to establish a low-stage gas flow rate in response to a low-stage activation signal (i.e., the second connector 134 receives a low-stage activation signal from the two-stage controller 20 for the heating unit 50). The valve controller 130 is configured to control the coil 120 to establish a high-stage gas flow rate while the high-stage activation signal is present (i.e., the first connector 132 receives a high-stage activation signal from the two-stage controller 20). Additionally, the valve controller 130 is configured to control the coil 120 to establish a low-stage gas flow rate while the low stage activation signal is present up to the low stage time limit, and to establish at least one intermediate gas flow rate between the low-stage and a high-stage full-capacity gas flow rate when the low stage activation signal is present beyond the low stage time limit.

As explained, the valve unit 100 in FIG. 2 is configured to move the valve member 122 to vary the gas flow rate based on the generated magnetic field, which is dependent on an input voltage applied to the coil 120. In the particular embodiment shown in FIG. 2, the valve unit 100 includes a solenoid operator in which the coil 120 is configured to move the valve element 112 to vary gas flow rate through the valve unit 100 based on the magnetic field generated by the coil 120. The valve member 122 is configured to directly vary an opening area relative to at least one valve seat 102, 103 to vary the gas flow rate. Accordingly, the valve member 122 is direct-acting, in that it moves in response to an electrical signal to vary an opening area, without any mechanical linkage to a diaphragm for displacing the valve member 122, as in conventional two-stage gas valve devices. The input voltage applied to the solenoid coil 120 is that which provides the desired low-stage gas flow rate and the high-stage full-capacity gas flow rate. However, other embodiments of a valve unit are contemplated in which input to a coil moves a valve member to vary a gas flow rate, as explained below.

Referring to FIG. 4, a second embodiment of a valve unit 100' is shown in which the coil 120 is part of a stepper-motor that displaces a valve element 112 based on a voltage applied to the stepper-motor coil. The stepper motor operated valve unit 100' includes a main diaphragm chamber 109, and a main diaphragm 104 disposed therein that is coupled to a valve element 112. The main diaphragm 104 controllably moves the valve member 122 and valve element 112 relative to a valve seat 102 to vary an opening area in response to changes in pressure in the main diaphragm chamber 109, to thereby permit adjustment of fuel flow through the valve seat 102. The valve unit 100' further includes a servo-regulator diaphragm 110, which is configured to regulate fluid flow to the main diaphragm chamber 109. The servo-regulator diaphragm 110 therefore controls the fluid pressure applied to the main diaphragm 104, to control the rate of flow through the valve seat 102. The stepper motor operated valve unit 100' also includes a stepper motor coil 120 configured to move in a stepwise manner to displace the servo-regulator diaphragm 110, for regulating fluid flow to the diaphragm chamber 109 to regulate the rate of flow through the valve unit 100'.

The stepper motor coil 120 accordingly provides control over the opening area of the valve seat 102, to provide modulated gas flow operation. One such stepper-motor operated valve is disclosed in U.S. patent application Ser. No. 13/031,517 filed on Feb. 21, 2011, which is entitled "Control of Stepper Motor Operated Valve" and is incorporated herein by reference. The stepper motor operated valve unit 100' preferably includes a valve controller 130 that is configured to receive an input control signal via a first connector 132 from the furnace controller 20 (shown in FIG. 2). As shown in FIG. 4, the stepper motor operated valve unit 100' drives the stepper motor coil 120 in a step-wise manner to the desired stepper motor coil position, which causes the stepper motor coil to displace the servo-regulator diaphragm 110 and valve member 122 the desired distance and thereby regulate the seat 102 in the valve, to thereby control the rate of fuel flow through the valve seat 102. The valve controller 130 determines the number of steps the stepper motor coil 120 must rotate to move the servo-regulator diaphragm 110 to establish the requested fuel flow level.

Accordingly, the various embodiments of a valve unit 100 comprise a valve member 122 that moves in response to a magnetic field generated by a coil 120, to vary a gas flow rate through the valve unit 100, where the valve member 122 is configured to moveably vary the gas flow rate based on the generated magnetic field. The various embodiments of a valve unit further comprise a valve controller 130 for controlling the input to the coil 120 for varying the gas flow rate of the valve unit 100, as explained below.

The above embodiments of a valve unit 100 have a valve controller 130 configured to be connected to and operable with a two-stage controller 20 that is designed to control a conventional two-stage gas valve that provides only two fixed gas flow rates. The present valve unit 100 and valve controller 130 provide for establishing at least one gas flow rate between the low-stage and high-stage gas flow rates when the low stage activation signal is present beyond a low stage time limit. Accordingly, the valve unit 100 may replace an existing conventional fixed two-stage gas valve within an installed two-stage furnace, or may be provided in place of a fixed two-stage gas valve of a new uninstalled two-stage furnace. The present valve unit 100 provides for interstitial heating stages or intermediate gas flow rates between the two fixed low-stage and high stage operating levels, to provide for improved comfort and efficiency over conventional fixed two-stage gas valves during extended periods of furnace operation, as explained below.

The valve controller 130 is configured to control input of voltage to the coil 120 to move valve member 122 to establish a high-stage gas flow rate while the high-stage activation signal is present. The valve controller 130 is configured to control the coil 120 to establish a low-stage gas flow rate while the low stage activation signal is present up to a low stage time limit, and to establish at least one gas flow rate between the low-stage and high-stage gas flow rates when the low stage activation signal is present beyond the low stage time limit. The low stage time limit may be a fixed time period, and may be a predetermined time period in the range of between 10 minutes and 20 minutes. Accordingly, when a two-stage controller 20 for the heating unit 50 communicates a low stage activation signal (in response to a "W1" signal from a thermostat) that is received via the second connector 134 on the valve unit 100, the valve controller 130 establishes the low-stage gas flow rate (e.g., W1 rate) for a low stage time limit period of 10 minutes, for example, after which the valve controller 130 establishes a first intermediate gas flow rate (e.g., W1A) that is between the low-stage and high-stage gas flow rates. This first intermediate gas flow rate is provided when the low stage activation signal is present beyond the low stage time limit. The valve controller 130 may be further configured to provide the first intermediate gas flow rate up to a second low stage time limit, and to thereafter establish a second intermediate gas flow rate (e.g., W1B) between the first intermediate gas flow rate (W1A) and the high-stage gas flow rate. This second intermediate gas flow rate is provided when the low stage activation signal is present beyond the second low stage time limit. Accordingly, the valve unit 100 and valve controller 130 are configured to establish at least two gas flow rates between the low-stage and high-stage gas flow rates when the low stage activation signal is present beyond the low stage time limit. While the above first and second low stage time limits are described as predetermined time periods, the controller may alternatively determine a low stage time limit based on a percentage of at least one heating cycle time period in which the low stage activation signal is present.

In the various embodiments of the present disclosure, the low stage time limit value may be variable in length, and may be determined based on a duty cycle value that is indicative of the heating load demand. The valve controller 130 may include a microcontroller or microprocessor that is configured to calculate a duty cycle value based on the percentage (or ratio) of the duration of time in which a signal requesting or calling for heat operation is present relative to the time duration of a heating cycle (e.g., the "on" time and subsequent "off" time before the next call for heat). For example, a duty cycle value of 80 percent is calculated where a 20 minute duration of heating operation was followed by a 5 minute off period before the start of the next heating cycle, to yield 20 minutes "on" during a 25 minute on and off heat cycle. The microcontroller determines a first stage time limit value from the calculated duty cycle value, wherein the first stage time limit value may be one of a plurality of time limit values in a look-up table that each correspond to a plurality of duty cycle value ranges (see Table 1).

In the various embodiments, the first stage of heating operation provides a lower level of heating operation than the second stage of heating operation. While a low stage activation signal is present at the second connector 134, the valve controller 130 controls operation of the valve unit 100 to provide a low stage gas flow rate for a time period not more than the low stage time limit (i.e.,—the default value or the time limit value determined from the duty cycle). The valve controller 130 then provides a first intermediate gas flow rate that is higher than the low-stage gas flow rate when a low stage activation signal has been present at the second connector 134 beyond the low stage time limit period. Unlike conventional fixed two-stage gas valves that only provide a low-stage gas flow rate and a high-stage gas flow rate, the valve unit 100 provides for operation at one or two intermediate gas flow rates above the low stage rate before switching to high stage heating operation.

In some embodiments of a valve unit 100, the valve controller 130 selects one of a plurality of low stage time limit values from a look-up table in a memory of the microcontroller or microprocessor, where the plurality of low stage time limit values correspond to a plurality of duty cycle value ranges. The duty cycle value range is generally proportional to the heating load demand of the two stage heating system, and is generally inversely proportional to the corresponding low stage time limit value, as shown in the Table below. Referring to Table 1, the low stage time limit value diminishes as the duty cycle value indicative of the heating load demand increases, such that the low stage gas flow rate (e.g., W1 rate) is provided for a minimum low stage time limit prior to activation of a first intermediate gas flow rate (e.g., W1A rate) when heating demand is high. Likewise, the low stage gas flow rate (e.g., W1 rate) is provided for a maximum low stage time limit prior to activation of a first intermediate gas flow rate (e.g., W1A rate) when heating demand is low.

TABLE 1

Duty Cycle and Low Stage Time Limit Values

| Duty Cycle Range (%) | Low Stage Time Limit | Heating Load Demand |
|---|---|---|
| 0 to 38 | 12 minute low stage | Light |
| 38 to 50 | 10 minutes low stage | Light to Average |
| 50 to 62 | 7 minutes low state | Average |
| 62 to 75 | 5 minutes low stage | Average to Heavy |
| 75 to 88 | 3 minutes low stage | Heavy |
| 88 to 100 | 1 minute low stage | Heavy |

It should be noted that initially, in the absence of a calculated duty cycle value, the low stage time limit value may be assigned a default time limit value, such as 15 minutes.

Referring to FIG. 5, a schematic diagram of the valve controller 130 is provided. The valve controller 130 may comprise a microprocessor 138 that is in communication with the first connector 132 configured to receive a high-stage activation signal, and with the second connector 134 configured to receive a low-stage activation signal (from a two-stage controller 20). The microprocessor 138 may control a switching device 136 to controllably switch a voltage on and off to provide a pulse-width modulated voltage signal to a coil 120, for controllably varying the gas flow rate of the valve. Alternatively, the microprocessor 138 may include pulse width modulation output that can directly control application of voltage to the coil 120.

In operation, the valve unit 100 monitors a first connector 132 configured to receive a high-stage activation signal, and a second connector 134 configured to receive a low-stage activation signal. In response to receiving a low-stage activation signal, the valve controller 130 controls input to the coil 120 to position a valve member that moves in response to a magnetic field generated by the coil 120, to establish gas flow through the valve unit 100. It should be noted that initially, the gas flow rate established may be at or near the high-stage full-capacity gas flow rate, to aid in the gas ignition process. Accordingly, after detecting the presence of a low-stage activation signal (and establishing ignition/flame presence), the valve controller 130 responsively establishes, within a predetermined time after detection of the low-stage activation signal, a low stage gas flow rate. The valve controller 130 may be further configured to determine a low stage time limit based on a percentage of at least one heating cycle time period in which the low stage activation signal is present, or to look up a predetermined low stage time limit stored in an electronic memory, for example. The valve controller 130 maintains the low stage gas flow rate while the low-stage activation signal is present, up to the low stage time limit. The valve controller 130 is further configured to establish at least one gas flow rate between the low-stage gas flow rate and the full capacity gas flow rate when the low stage activation signal is present beyond the low stage time limit. Specifically, the valve controller 130 is configured to establish a first intermediate gas flow rate between the low-stage and high-stage gas flow rates, and may maintain the first intermediate gas flow rate up to a second low stage time limit. After the second low stage time limit period has elapsed, the valve controller 130 may be configured to establish a second gas flow rate between the first intermediate gas flow rate and high-stage gas flow rate when the low stage activation signal is present beyond the second low stage time limit. Thus, when the first low stage time limit period elapses, the valve controller 130 establishes a first intermediate gas flow rate (e.g., W1A rate) above the low-stage gas flow rate (e.g., W1 rate), and when the second low stage time limit period elapses, the valve controller 130 establishes a second intermediate gas flow rate (e.g., W1B rate) that is above the first intermediate gas flow rate.

Additionally, when a two-stage controller 20 for a furnace communicates a high-stage activation signal (in response to a "W2" signal from a thermostat) to the valve unit 100, the valve unit 100 establishes the high-stage full capacity gas flow rate to the burner 58 (FIG. 1), which rate is commensurate with a corresponding full-capacity combustion air flow to the burner 58 that is established by an inducer fan/blower motor. When a two-stage controller 20 for a furnace communicates a low-stage activation signal (in response to a "W1" signal from a thermostat) to the valve unit 100, the valve unit 100 establishes the low-stage full capacity gas flow rate to the burner 58, which rate is commensurate with a corresponding reduced-capacity combustion air flow to the burner 58 that is established by an inducer fan/blower motor. Depending on the detection of a low-stage activation signal or high-stage activation signal, the valve unit 100 may be configured to establish one or more intermediate gas flow rates (e.g., W1A or W1B rates) that are higher than the low-stage gas flow rate but lower than the high-stage gas flow rate. It should be noted that the one or more intermediate gas flow rates (e.g., W1A or W1B rates) preferably supply gas flow that is within the limits for excess combustion air flow being supplied to the burner 58 by an inducer fan/blower.

Where the high-stage activation signal is terminated and the low-stage activation signal is received, the valve controller 130 may be further configured to discontinue the high-stage gas flow rate, and establish the second intermediate gas flow rate (e.g., W1B rate) up to the first low-stage time limit, rather than providing the low-stage gas flow rate corresponding to the low-stage activation signal. The valve controller 130 may thereafter establish the first intermediate gas flow rate (e.g., W1B rate) up to the second low-stage time limit, before finally establishing the low-stage gas flow rate corresponding to the low-stage activation signal. This provides a more gradual reduction in the level of heating provided by the furnace, which provides the advantage of comfort to occupants of a space, since furnace operation is switched from full-capacity to an intermediate capacity before lowering to the low-stage capacity level of operation. Accordingly, the occupant would not experience sudden discomfort that would result from the substantial difference between the high-stage full capacity heating rate and the low-stage heating rate.

In view of the above, and in accordance with another aspect of the present disclosure, a method is provided for controlling a valve unit for adjusting gas flow to a two-stage combustion apparatus. The method comprises detecting the presence of a low-stage activation signal from a two-stage controller 20 (e.g., a heating system controller), and establishing, within a predetermined time after detection of the low-stage activation signal, a low stage gas flow rate while the low-stage activation signal is present up to the low stage time limit. The method further comprises the step of establishing at least one gas flow rate between the low-stage gas flow rate and the full capacity gas flow rate when the low stage activation signal is present beyond the low stage time limit.

Accordingly, unlike conventional two-stage gas valves that only provide a fixed low-stage flow rate and fixed high-stage flow rate, the valve units of the present disclosure provide the advantage of establishing at least one gas flow rate between the low-stage and high-stage gas flow rates when the low stage activation signal is present beyond a low stage time limit. The various embodiments of a valve unit are adapted to be connected to and operable with a two-stage controller for a furnace, and may replace an existing conventional fixed two-stage gas valve within an installed two-stage furnace, or may be provided in place of a fixed two-stage gas valve of a new uninstalled two-stage furnace. The present valve unit embodiments offer an advantage over conventional two-stage gas valves by providing for more gradual changes in the supplied heating level (than a conventional two-stage gas valve), which provides improved efficiency since heating is ramped up gradually instead of being switched to full-capacity operation. The present valve unit embodiments also provide the advantage of comfort to occupants of a space, since furnace operation is switched from full-capacity to an intermediate capacity before lowering to the low-stage capacity level of operation. Accordingly, the occupant would not experience sudden discomfort that would result from the substantial difference between the high-stage full capacity heating rate and the low-stage heating rate. These and other advantages provide novel advantageous improvements over conventional two-stage gas valves.

Thus, it will be understood by those skilled in the art that the above described embodiments and combinations thereof may be employed in various types of heating systems with any combination of the above disclosed features, without implementing the others. It will be understood that the stepper motor driven gas valve and controller described above may be utilized in other forms of heating and cooling equipment, including water heater and boiler appliances. Accordingly, it should be understood that the disclosed embodiments, and variations thereof, may be employed without departing from the scope of the invention.

What is claimed is:

1. A valve unit for adjusting gas flow to a two-stage combustion apparatus, the valve comprising:

a valve member that moves in response to a magnetic field generated by a coil to vary a gas flow rate through the valve unit;

a first connector configured to receive a high-stage activation signal;

a second connector configured to receive a low-stage activation signal;

a valve controller configured to control the coil to establish a high-stage gas flow rate while the high-stage activation signal is present at the first connector, and configured to control the coil to establish a low-stage gas flow rate while the low-stage activation signal is present at the second connector up to a low stage time limit, the valve controller being further configured to establish at least one intermediate gas flow rate between the low-stage and high-stage gas flow rates when the low-stage activation signal is present beyond the low stage time limit, the valve controller being further configured to discontinue the high-stage gas flow rate and establish the at least one intermediate gas flow rate up to the low stage time limit when the high-stage activation signal is no longer detected and establish the low-stage gas flow rate after the low stage time limit.

2. The valve unit of claim 1, wherein the valve member is configured to moveably vary the gas flow rate based on a magnetic field that is generated in response to an input signal applied to the coil.

3. The valve unit of claim 1, wherein the coil comprises at least one coil of a stepper-motor that moves the valve member based on an input to the at least one coil.

4. The valve unit of claim 3, wherein the valve member is configured to displace a diaphragm to vary the gas flow rate through the valve unit.

5. The valve unit of claim 2, wherein the coil is a solenoid coil that is configured to move the valve member to vary gas flow rate through the valve unit based on a magnitude of the generated magnetic field that is dependent on an input voltage applied to the solenoid coil.

6. The valve unit of claim 5, wherein the valve member is configured to directly vary an opening relative to a valve seat to vary the gas flow rate, without any mechanical linkage to a diaphragm.

7. The valve unit of claim 5, wherein the input voltage applied to the solenoid coil is based in part on the level of the at least one intermediate gas flow rate.

8. The valve unit of claim 1, wherein the intermediate gas flow rate comprises a first gas flow rate between the low-stage and high-stage gas flow rates, the controller configured to establish at least a second gas flow rate between the low-stage and high-stage gas flow rates when the low-stage activation signal is present beyond the low stage time limit.

9. The valve unit of claim 8, wherein the controller is configured to establish the first gas flow rate between the low-stage and high-stage gas flow rates up to a second low stage time limit, and to establish the second gas flow rate between the first gas flow rate and high-stage gas flow rate when the low-stage activation signal is present beyond the second low stage time limit.

10. The valve unit of claim 1, wherein the controller is configured to determine a low stage time limit based on a percentage of at least one heating cycle time period in which the low-stage activation signal is present.

11. The valve unit of claim 1, wherein the low stage time limit is based on a predetermined time period in the range of between 10 minutes and 20 minutes.

12. A valve unit for adjusting gas flow to a combustion apparatus, the valve comprising:

a valve member that moves in response to a magnetic field generated by a coil to vary a gas flow rate through the valve unit, wherein the valve member is configured to vary the gas flow rate based on a magnetic field that is generated in response to an input signal applied to the coil;

a first connector configured to receive a high-stage activation signal;

a second connector configured to receive a low-stage activation signal;

a controller configured to determine a low stage time limit based on a percentage of at least one heating cycle time period in which the low-stage activation signal is present at the first connector, where the controller controls the coil to establish a high-stage gas flow rate while the high-stage activation signal is present at the first connector, and controls the coil to establish a low-stage gas flow rate while the low-stage activation signal is present at the second connector up to the low stage time limit, the controller being further configured to establish at least one gas flow rate between the low-stage and high-stage gas flow rates when the low-stage activation signal is present beyond the low stage time limit, the valve controller being further configured to discontinue the high-stage gas flow rate and establish the at least one gas flow rate between the low-stage and high-stage gas flow rates up to the low stage time limit when the high-stage activation signal is no longer detected and establish the low-stage gas flow rate after the low stage time limit.

13. The valve unit of claim 12, wherein the coil comprises at least one coil of a stepper-motor that moves the valve member based on an input to the at least one coil.

14. The valve unit of claim 13, wherein the valve member is configured to displace a diaphragm to vary the gas flow rate through the valve unit.

15. The valve unit of claim 12, wherein the coil is a solenoid coil that is configured to move the valve member to vary gas flow rate through the valve unit based on a magnitude of the generated magnetic field that is dependent on an input voltage applied to the solenoid coil.

16. The valve unit of claim 15, wherein the valve member is configured to directly vary an opening relative to a valve seat to vary the gas flow rate, without any mechanical linkage to a diaphragm.

17. The valve unit of claim 15, wherein the input voltage applied to the solenoid coil is based in part on the level of the at least one intermediate gas flow rate.

18. The valve unit of claim 12, wherein the at least one gas flow rate between the low-stage and high-stage gas flow rates comprises a first gas flow rate between the low-stage and high-stage gas flow rates, the controller configured to establish at least a second gas flow rate between the low-stage and high-stage gas flow rates when the low-stage activation signal is present beyond the low stage time limit.

19. The valve unit of claim 18, wherein the controller is configured to establish the first gas flow rate between the low-stage and high-stage gas flow rates up to a second low stage time limit, and to establish the second gas flow rate between the first gas flow rate and high-stage gas flow rate when the low-stage activation signal is present beyond the second low stage time limit.

* * * * *